US007947642B2

(12) United States Patent
Somerville Roberts et al.

(10) Patent No.: US 7,947,642 B2
(45) Date of Patent: May 24, 2011

(54) SPRAY-DRYING PROCESS FOR PREPARING A LOW DENSITY, LOW BUILDER, HIGHLY WATER-SOLUBLE SPRAY-DRIED DETERGENT POWDER

(75) Inventors: Nigel Patrick Somerville Roberts, Newcastle Upon Tyne (GB); Paul Andrzej Luksza, Newcastle Upon Tyne (GB); Gordon Ridley, Newcastle Upon Tyne (GB); Callum Niall Fergus Finlay, Newcastle Upon Tyne (GB); Alan Thomas Brooker, Newcastle Upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 327 days.

(21) Appl. No.: 11/974,839

(22) Filed: Oct. 16, 2007

(65) Prior Publication Data

US 2008/0261854 A1 Oct. 23, 2008

(30) Foreign Application Priority Data

Oct. 16, 2006 (EP) ..... 06021613

(51) Int. Cl.
*C11D 11/02* (2006.01)

(52) U.S. Cl. ..... 510/443; 510/452

(58) Field of Classification Search ..... 510/443, 510/452

See application file for complete search history.

(56) References Cited

U.S. PATENT DOCUMENTS

| | | | | |
|---|---|---|---|---|
| 2,298,650 | A | 10/1942 | Samaras et al. | |
| 3,799,880 | A | 3/1974 | Kelly et al. | |
| 3,816,352 | A | 6/1974 | Loureiro et al. | |
| 3,962,149 | A * | 6/1976 | Chirash et al. | 510/283 |
| 4,129,511 | A * | 12/1978 | Ogoshi et al. | 510/443 |
| 5,151,208 | A * | 9/1992 | Huijben et al. | 510/452 |
| 5,726,142 | A * | 3/1998 | Partee et al. | 510/276 |
| 6,221,831 | B1 * | 4/2001 | Emery et al. | 510/438 |
| 6,528,474 | B1 * | 3/2003 | Artiga Gonzalez et al. | 510/453 |
| 7,078,373 | B2 * | 7/2006 | Burrows et al. | 510/351 |
| 2003/0203832 | A1 * | 10/2003 | Boucher et al. | 510/443 |
| 2005/0101503 | A1 * | 5/2005 | Caldwell et al. | 510/310 |
| 2005/0187117 | A1 * | 8/2005 | Somerville Roberts et al. | 510/108 |
| 2005/0187130 | A1 * | 8/2005 | Brooker et al. | 510/445 |
| 2005/0187131 | A1 * | 8/2005 | Brooker et al. | 510/446 |
| 2006/0069007 | A1 * | 3/2006 | Edward Boucher et al. | 510/446 |
| 2006/0213801 | A1 * | 9/2006 | Karaoren et al. | 206/524.7 |
| 2008/0045435 | A1 * | 2/2008 | Somerville Roberts et al. | 510/446 |

FOREIGN PATENT DOCUMENTS

| | | | |
|---|---|---|---|
| DE | 41 02 745 | A1 | 8/1992 |
| EP | 1416039 | A1 | 5/2004 |
| EP | 1416040 | A1 | 5/2004 |
| EP | 1690921 | A1 | 8/2006 |
| EP | 1690922 | A1 | 8/2006 |
| GB | 2 159 534 | A | 12/1985 |
| WO | WO 93/23514 | A | 11/1993 |
| WO | WO0039261 | A1 | 7/2000 |
| WO | WO03/038028 | A2 | 5/2003 |
| WO | WO 2005/035382 | A1 * | 4/2005 |
| WO | WO2005/083046 | A1 | 9/2005 |
| WO | WO2005/083048 | A1 | 9/2005 |
| WO | WO2005/083049 | A3 | 9/2005 |
| WO | WO2006/020788 | A1 | 2/2006 |
| WO | WO2006/020789 | A1 | 2/2006 |
| WO | WO2006/088665 | A1 | 8/2006 |
| WO | WO2006/088666 | A1 | 8/2006 |

* cited by examiner

*Primary Examiner* — Lorna M Douyon
(74) *Attorney, Agent, or Firm* — Julie A. McConihay; Leonard W. Lewis; Steven W. Miller

(57) ABSTRACT

The present invention relates to a spray-drying process for the preparation of a spray-dried detergent powder having a bulk density of 426 g/l or less, wherein the spray-dried detergent powder comprises an anionic detersive surfactant and from 0 wt % to 10 wt % zeolite builder and from 0 wt % to 10 wt % phosphate builder, and wherein the process comprises the step of: (a) preparing an aqueous slurry suitable for spray-drying comprising from 30 wt % to 60 wt % water and from 40 wt % to 70 wt % non-aqueous material, wherein the non-aqueous material comprises an inorganic component and an organic component, wherein the weight ratio of the inorganic component to organic component is in the range of from 0.3:1 to 5:1; and (b) spraying the slurry into a spray-drying tower, wherein the temperature of the slurry as it enters the spray-drying tower is in the range of from 65° C. to 140° C., and wherein the outlet air temperature of the spray-drying tower is in the range of from 70° C. to 120° C.

10 Claims, No Drawings

SPRAY-DRYING PROCESS FOR PREPARING A LOW DENSITY, LOW BUILDER, HIGHLY WATER-SOLUBLE SPRAY-DRIED DETERGENT POWDER

FIELD OF THE INVENTION

The present invention relates to a spray-drying process for the preparation of a low density, low builder, highly water-soluble spray-dried powder. The spray-dried powder is suitable for use as a solid laundry detergent composition, or for incorporation into a solid laundry detergent composition. The spray-drying process comprises the step of spray-drying an aqueous slurry comprising a large amount of water. The conditions of the spray-drying process promote steam puffing; which in turn leads to the formation of spray-dried detergent powder having a very low bulk density. The spray-dried detergent powder exhibits excellent solubility upon contact with water, even in cold water temperatures, such as 20° C. or lower.

BACKGROUND OF THE INVENTION

In recent years, the manufacturers of solid laundry detergent products have focused their efforts into formulating highly water-soluble laundry detergent compositions that exhibit a good cleaning performance and a good dissolution performance in water. Some examples of these efforts are described in: DE19912679 and WO03/038028, both by Henkel KGaA; EP1416039 and EP1416040, both by Dalli-Werke Wasche und Korperflege GmbH & Co. KG; and WO05/083046, WO05/083048, WO05/083049, WO06/020788, WO06/020789, WO06/088665, WO06/088666, EP1690921 and EP1690922, all by The Procter & Gamble Company.

These attempts typically remove a large proportion of the composition, namely the zeolite and/or phosphate builder, and preferably at least some sulphate salt. This in turn means that a lower dosage of the composition during the laundering process is required. However, many consumers do not want to dose a smaller volume of detergent during their laundering process. Therefore, there remains a need to significantly reduce the bulk density of these low builder laundry detergent compositions. This in turn enables the consumer to dose the same volume of these low builder laundry detergents they have used in the past for the more conventional high builder laundry detergents, during their laundering process. The use of low builder laundry detergent powders, due to their improved solubility in water, enables lower washing temperatures to be used, which improves the environmental and economic cost of the laundering process.

SUMMARY OF THE INVENTION

The Inventors have overcome the above problem by providing a spray-drying process.

DETAILED DESCRIPTION OF THE INVENTION

Spray-drying process. The spray-drying process comprises the steps of preparing an aqueous slurry, and spraying the aqueous slurry into a spray-drying tower.

Typically, the aqueous slurry is prepared at a temperature in the range of from 60° C. to 80° C. Typically the liquid ingredients, including ingredients in the form of a hot-melt, such as chelants, polymeric carboxylates, linear alkyl benzene sulphonate, that make up the aqueous slurry, including the water, are pre-heated to a temperature in the range of from 60° C. to 80° C.

Preferably, essentially all of the detersive surfactant, if present, is contacted to the water before essentially any polymer is contacted to the water. Preferably essentially all of the polymer, if present, is contacted to the water before essentially any inorganic material. This is especially preferred as it ensures the optimal phase chemistry of the aqueous slurry for spray-drying.

Typically, the temperature of the aqueous slurry as it enters the spray-drying tower is in the range of from 50° C. to 140° C., preferably from 60° C., or from 70° C., and preferably to 120° C., or to 99° C. or to 95° C. or to 90° C., or to 85° C., or even to 80° C.

Typically, the outlet air temperature of the spray-drying tower is in the range of from 50° C. to 200° C., preferably from 60° C., or from 70° C. or even 80° C., and preferably to 140° C., or to 120° C., or to 99° C. or to 95° C. or to 90° C., or even to 85° C.

Typically, the air flow rate in the spray-drying tower is in the range of from 1 $m^3 s^{-1}$ to 40 $m^3 s^{-1}$, preferably from 5 $m^3 s^{-1}$, or from 10 $m^3 s^{-1}$ or from 15 $m^3 s^{-1}$ or even from 20 $m^3 s^{-1}$, and preferably to 35 $m^3 s^{-1}$, or even to 30 $m^3 s^{-1}$.

Typically, the maximum cross-sectional area of the spray-drying tower is in the range of from 2 $m^2$ to 70 $m^2$, preferably from 10 $m^2$, or from 20 $m^2$, or from 30 $m^2$, or from 40 $m^2$, and preferably to 60 $m^2$.

Typically, the ratio of (i) the air flow rate in the spray-drying tower to (ii) the maximum cross-sectional area of the spray-drying tower is in the range of from 0.15 $ms^{-1}$ to 4 $ms^{-1}$, preferably from 0.2 $ms^{-1}$, or from 0.3 $ms^{-1}$, or even from 0.4 $ms^{-1}$, and preferably to 3 $ms^{-1}$, or to 2 $ms^{-1}$, or to 1 $ms^{-1}$, or even to 0.75 $ms^{-1}$. This is especially preferred in order to control the residency time of the aqueous slurry in the spray-drying tower so as to ensure adequate drying time. This is even more preferred when it is desirable to spray-dry at lower air temperatures.

Typically, the aqueous slurry is sprayed into the spray-drying tower through at least one nozzle, preferably multiple nozzles, having an aperture in the range of from 2 mm to 5 mm, preferably from 3 mm, or from 3.5 mm, and preferably to 4 mm.

Typically, the slurry is sprayed into the spray-drying tower at a pressure in the range of from $4.0\times10^6$ $Nm^{-2}$ to $9.0\times10^6$ $Nm^{-2}$, preferably from $5.0\times10^6$ $Nm^{-2}$, and preferably to $7.0\times10^6$ $Nm^{-2}$, or even to $6.0\times10^6$ $Nm^{-2}$. These pressures, especially these low pressures, promote steam puffing, which in turn lead to the formation of spray-dried detergent powder having a very low density.

Typically, the ratio of (i) the rate in $gs^{-1}$ units at which the aqueous slurry is sprayed into the spray-drying tower to (ii) the maximum cross-sectional area in $m^2$ units of the spray-drying tower is in the range of from 3 $gm^{-2} s^{-1}$ to 3,000 $gm^{-2} s^{-1}$, preferably from 20 $gm^{-2} s^{-1}$, or from 40 $gm^{-2} s^{-1}$, or even from 60 $gm^{-2} s^{-1}$, and preferably to 2,000 $gm^{-2} s^{-1}$, or to 1,000 $gm^{-2} s^{-1}$, or to 500 $gm^{-2} s^{-1}$, or to 250 $gm^{-2} s^{-1}$, or even to 150 $gm^{-2}s^{-1}$. This is especially preferred in order to control the residency time of the aqueous slurry in the spray-drying tower so as to ensure adequate drying time. This is even more preferred when it is desirable to spray-dry at lower air temperatures.

Spray-dried detergent powder. The spray-dried detergent powder has a bulk density of 426 g/l or less, preferably from 100 g/l, and preferably of 400 g/l or less, or 300 g/l or less, or even 200 g/l or less. The method for determining the bulk density of the spray-dried powder is described in more detail below.

Typically, the spray-dried detergent powder comprises anionic detersive surfactant, from 0 wt % to 10 wt % zeolite builder, from 0 wt % to 10 wt % phosphate builder, preferably from 0 wt % to 10 wt % silicate salt. Typically, the spray-dried detergent powder comprises a polymeric carboxylate and carbonate salt. The anionic detersive surfactant, zeolite builder, phosphate builder, silicate salt, polymeric carboxylate, and carbonate salt are described in more detail below.

Typically, the spray-dried detergent powder is suitable for use as, or for incorporation into, a solid laundry detergent composition. The spray-dried powder can be admixed with other detergent ingredients, such as dry-added sodium percarbonate, anionic detersive surfactant agglomerates, enzymes or other spray-dried powders, to form a solid laundry detergent composition.

Typically, the spray-dried detergent powder comprises a polymeric component and a non-polymeric component. The polymeric component and non-polymeric component are described in more detail below. Typically, and even preferably, the spray-dried detergent powder comprises an inorganic component and an organic component. The inorganic component and organic component are described in more detail below.

Aqueous slurry. The aqueous slurry is suitable for spray-drying. The aqueous slurry comprises from 30 wt % to 60 wt % water, preferably from 35 wt %, or from 40 wt %, or from 45 wt %, or even from 50 wt % water, and preferably to 55 wt % water. The aqueous slurry comprises from 40 wt % to 70 wt % non-aqueous material, preferably from 45 wt %, and preferably to 65 wt %, or to 60 wt %, or to 55 wt %, or even to 50 wt % non-aqueous material. The non-aqueous material means any material that is not water. The non-aqueous material is described in more detail below.

The aqueous slurry has a viscosity of from 0.2 Pas to 2.0 Pas, when measured at a shear rate of 1,000 $s^{-1}$ and at a temperature of 70° C.

Non-aqueous material. The non-aqueous material is any material that is not water. The non-aqueous material typically comprises an inorganic component and an organic component. The inorganic component and organic component are described in more detail below. Typically, the non-aqueous material comprises an inorganic component and organic component in a weight ratio of from 0.1:1 to 10:1, preferably from 0.2:1, or even from 0.3:1, and preferably to 5:1, or to 3:1, or to 1.5:1, or to 1.2:1, or to 1.0:1, or to 0.8:1, or even to 0.5:1.

The non-aqueous material typically comprises a polymeric component and a non-polymeric component.

Typically, the non-aqueous material comprises anionic detersive surfactant, polymeric carboxylate and carbonate salt. The anionic detersive surfactant, polymeric carboxylate, and carbonate salt are described in more detail below. It may be preferred that the non-aqueous material comprises from 0 wt % to 5 wt % alkyl alkoxylated sulphate anionic detersive surfactant, preferably to 4 wt %, or to 3 wt %, or to 2 wt %, or to 1 wt % alkyl alkoxylated sulphate anionic detersive surfactant.

It may even be preferred that the non-aqueous material comprises essentially no alkyl alkoxylated sulphate anionic detersive surfactant; by comprises essentially no alkyl alkoxylated sulphate anionic detersive surfactant it is meant that the non-aqueous material comprises no deliberately added alkyl alkoxylated sulphate anionic detersive surfactant. This is especially preferred if the non-aqueous material comprises an alkyl benzene sulphonate anionic detersive surfactant.

Typically, the non-aqueous material comprises from 0 wt % to 10 wt % zeolite builder, preferably to 8 wt %, or 6 wt %, or to 4 wt % or to 2 wt % zeolite builder. It may even be preferred for the non-aqueous material to be essentially free from zeolite builder. By essentially free from zeolite builder it is typically meant that the non-aqueous material comprises no deliberately added zeolite builder.

Typically, the non-aqueous material comprises from 0 wt % to 10 wt % phosphate builder, preferably to 8 wt %, or 6 wt %, or to 4 wt % or to 2 wt % phosphate builder. It may even be preferred for the non-aqueous material to be essentially free from phosphate builder. By essentially free from phosphate builder it is typically meant that the non-aqueous material comprises no deliberately added phosphate builder.

Typically, the non-aqueous material comprises from 0 wt % to 10 wt % silicate salt, preferably to 8 wt %, or 6 wt %, or to 4 wt % or to 2 wt % silicate salt. It may even be preferred for the non-aqueous material to be essentially free from silicate salt. By essentially free from silicate salt it is typically meant that the non-aqueous material comprises no deliberately added silicate salt.

Inorganic component: For the purpose of the present invention, inorganic component is defined as any material that does not comprise a hydrocarbon moiety. Examples of inorganic component include sodium carbonate and sodium sulphate.

Organic component: For the purpose of the present invention, organic component is defined as any material that comprises a hydrocarbon moiety. For the purpose of the present invention, a hydrocarbon moiety comprises a carbon atom that is covalently bonded to a hydrogen atom: i.e. having the general formula:

C—H

Examples of organic component include alkyl benzene sulphonate and citric acid.

Polymeric component. For the purpose of the present invention, the polymeric component is defined as any material that comprises at least four monomer units and has a molecular weight of 1,000 Da or greater.

Non-polymeric component. For the purpose of the present invention, the non-polymeric component is defined as any material that comprises less than four monomer units and/or has a molecular weight of less than 1,000 Da.

Anionic detersive surfactant: The spray-dried powder typically comprises from 1 wt % to 70 wt % anionic detersive surfactant, preferably from 2 wt %, or from 5 wt %, or from 7 wt %, or even from 10 wt %, and preferably to 60 wt %, or to 50 wt %, or to 40 wt %, or even to 30 wt % anionic detersive surfactant. Suitable anionic detersive surfactants are alkoxylated alcohol sulphate anionic detersive surfactants such as linear or branched, substituted or unsubstituted ethoxylated $C_{12-18}$ alcohol sulphates having an average degree of ethoxylation of from 1 to 10, preferably from 3 to 7. Other suitable anionic detersive surfactant are alkyl benzene sulphonate anionic detersive surfactants such as linear or branched, substituted or unsubstituted $C_{8-18}$ alkyl benzene sulphonates, preferably linear unsubstituted $C_{10-13}$ alkyl benzene sulphonates. Other suitable anionic detersive surfactants are alkyl sulphates, alkyl sulphonates, alkyl phosphates, alkyl phosphonates, alkyl carboxylates or any mixture thereof.

Polymeric carboxylate. The spray-dried powder preferably comprises polymeric carboxylate. It may be preferred for the spray-dried powder to comprise at least 1 wt %, or at least 2 wt %, or at least 3 wt %, or at least 4 wt %, or even at least 5 wt % polymeric carboxylate. The polymeric carboxylate can sequester free calcium ions in the wash liquor. The polymeric carboxylate can also act as a soil dispersant and can provide an improved particulate stain removal cleaning benefit. Preferred polymeric carboxylates include: polyacrylates, preferably having a weight average molecular weight of from 1,000 Da to 20,000 Da; co-polymers of maleic acid and acrylic acid, preferably having a molar ratio of maleic acid monomers to acrylic acid monomers of from 1:1 to 1:10 and a weight average molecular weight of from 10,000 Da to 200,000 Da, or preferably having a molar ratio of maleic acid monomers to acrylic acid monomers of from 0.3:1 to 3:1 and a weight average molecular weight of from 1,000 Da to 50,000 Da.

Carbonate salt. The spray-dried powder typically comprises carbonate salt, typically from 1 wt % to 50 wt %, or from 5 wt % to 25 wt % or from 10 wt % to 20 wt % carbonate salt. A preferred carbonate salt is sodium carbonate and/or sodium bicarbonate. A highly preferred carbonate salt is sodium carbonate. Preferably, the spray-dried powder may comprise from 10 wt % to 40 wt % sodium carbonate. However, it may also be preferred for the spray-dried powder to comprise from 2 wt % to 8 wt % sodium bicarbonate. Sodium bicarbonate at these levels provides good alkalinity whilst minimizing the risk of surfactant gelling which may occur in surfactant-carbonate systems. If the spray-dried powder comprises sodium carbonate and zeolite builder, then preferably the weight ratio of sodium carbonate to zeolite builder is at least 15:1.

The carbonate salt, or at least part thereof, is typically in particulate form, typically having a weight average particle size in the range of from 200 to 500 micrometers. However, it may be preferred for the carbonate salt, or at least part thereof, to be in micronised particulate form, typically having a weight average particle size in the range of from 4 to 40 micrometers; this is especially preferred when the carbonate salt, or at least part thereof, is in the form of a co-particulate admixture with a detersive surfactant, such as the alkyl benzene sulphonate, or alternatively with an alkoxylated anionic detersive surfactant.

High levels of carbonate improve the cleaning performance of the spray-dried powder by increasing the pH of the wash liquor. This increased alkalinity: improves the performance of the bleach, if present; increases the tendency of soils to hydrolyze, which facilitates their removal from the fabric; and also increases the rate, and degree, of ionization of the soils to be cleaned (n.b. ionized soils are more soluble and easier to remove from the fabrics during the washing stage of the laundering process). In addition, high carbonate levels improve the flowability of the spray-dried powder.

Zeolite builder: The spray-dried detergent powder typically comprises from 0 wt % to 10 wt % zeolite builder, preferably to 8 wt %, or to 6 wt %, or to 5 wt %, or to 4 wt % or to 2 wt % zeolite builder. It may even be preferred for the spray-dried detergent powder to be essentially free from zeolite builder. By essentially free from zeolite builder it is typically meant that the spray-dried detergent powder comprises no deliberately added zeolite builder. This is especially preferred if it is desirable for the spray-dried detergent powder to be very highly water-soluble, to minimize the amount of water-insoluble residues (for example, which may deposit on fabric surfaces), and also when it is highly desirable to have transparent wash liquor. Zeolite builders include zeolite A, zeolite X, zeolite P and zeolite MAP.

Phosphate builder: The spray-dried detergent powder typically comprises from 0 wt % to 10 wt % phosphate builder, preferably to 8 wt %, or to 6 wt %, or to 5 wt %, or to 4 wt % or to 2 wt % phosphate builder. It may even be preferred for the spray-dried detergent powder to be essentially free from phosphate builder. By essentially free from phosphate builder it is typically meant that the spray-dried detergent powder comprises no deliberately added phosphate builder. This is especially preferred if it is desirable for the spray-dried detergent powder to have a very good environmental profile. Phosphate builders include sodium tripolyphosphate.

Silicate salt: The spray-dried detergent powder preferably comprises from 0 wt % to 10 wt % silicate, preferably to 8 wt %, or 6 wt %, or to 4 wt % or to 2 wt % silicate salt. It may even be preferred for the spray-dried detergent powder to be essentially free from silicate salt. By essentially free from silicate salt it is typically meant that the spray-dried detergent powder comprises no deliberately added silicate salt. This is especially preferred in order to ensure that the spray-dried detergent powder has a very good dispensing and dissolution profiles and to ensure that the spray-dried detergent powder provides a clear wash liquor upon dissolution in water. Silicate salts include water-insoluble silicates. Silicate salts include amorphous silicates and crystalline layered silicates (e.g. SKS-6). A typical silicate salt is sodium silicate.

Other detergent ingredients: The spray-dried powder, and the non-aqueous component of the aqueous slurry, typically comprises detergent ingredients. Suitable detergent ingredients include: detersive surfactants such as anionic detersive surfactants, nonionic detersive surfactants, cationic detersive surfactants, zwitterionic detersive surfactants, amphoteric detersive surfactants; preferred non-ionic detersive surfactants are $C_{8-18}$ alkyl alkoxylated alcohols having an average degree of alkoxylation of from 1 to 20, preferably from 3 to 10, most preferred are $C_{12-18}$ alkyl ethoxylated alcohols having an average degree of alkoxylation of from 3 to 10; preferred cationic detersive surfactants are mono-$C_{6-18}$ alkyl mono-hydroxyethyl di-methyl quaternary ammonium chlorides, more preferred are mono-$C_{8-10}$ alkyl mono-hydroxyethyl di-methyl quaternary ammonium chloride, mono-$C_{10-12}$ alkyl mono-hydroxyethyl di-methyl quaternary ammonium chloride and mono-$C_{10}$ alkyl mono-hydroxyethyl di-methyl quaternary ammonium chloride; source of peroxygen such as percarbonate salts and/or perborate salts, preferred is sodium percarbonate, the source of peroxygen is preferably at least partially coated, preferably completely coated, by a coating material such as a carbonate salt, a sulphate salt, a silicate salt, borosilicate, or mixtures, including mixed salts, thereof; bleach activator such as tetraacetyl ethylene diamine, oxybenzene sulphonate bleach activators such as nonanoyl oxybenzene sulphonate, caprolactam bleach activators, imide bleach activators such as N-nonanoyl-N-methyl acetamide, preformed peracids such as N,N-pthaloylamino peroxycaproic acid, nonylamido peroxyadipic acid or dibenzoyl peroxide; carbonate salts, preferably sodium carbonate and/or sodium bicarbonate, preferably sodium carbonate; polymeric carboxylates, preferably co-polymers of maleic acid and acrylic acid and salts thereof; enzymes such as amylases, carbohydrases, cellulases, laccases, lipases, oxidases, peroxidases, proteases, pectate lyases and mannanases; suds suppressing systems such as silicone based suds suppressors; fluorescent whitening agents; photobleach; filler salts such as sulphate salts, preferably sodium sulphate; fabric-softening agents such as clay, silicone and/or quaternary ammonium compounds; flocculants such as polyethylene oxide; dye transfer inhibitors such as polyvinylpyrrolidone, poly 4-vinylpyridine N-oxide and/or co-polymer of vinylpyrrolidone and vinylimidazole; fabric integrity components such as hydrophobically modified cellulose and oligomers produced by the condensation of imidazole and epichlorhydrin; soil dispersants and soil anti-redeposition aids such as alkoxylated polyamines and ethoxylated ethyleneimine polymers; anti-redeposition components such as carboxymethyl cellulose and polyesters; perfumes; sulphamic acid or salts thereof; citric acid or salts thereof; and dyes such as orange dye, blue dye, green dye, purple dye, pink dye, or any mixture thereof.

Preferably, the composition comprises less than 1 wt % chlorine bleach and less than 1 wt % bromine bleach. Preferably, the composition is essentially free from bromine bleach and chlorine bleach. By "essentially free from" it is typically meant "comprises no deliberately added".

Method for determining the bulk density of the spray-dried powder. The bulk density is typically determined by the following method:

Summary: A 500 ml graduated cylinder is filled with a powder, the weight of the sample is measured and the bulk density of the powder is calculated in g/l.

Equipment:

1. Balance. The balance has a sensitivity of 0.5 g.
2. Graduated cylinder. The graduated cylinder has a capacity 500 ml. The cylinder should be calibrated at the 500 ml mark, by using 500 g of water at 20° C. The cylinder is cut off at the 500 ml mark and ground smooth.
3. Funnel. The funnel is cylindrical cone, and has a top opening of 110 mm diameter, a bottom opening of 40 mm diameter, and sides having a slope of 76.4° to the horizontal.
4. Spatula. The spatula is a flat metal piece having of a length of at least 1.5 times the diameter of the graduated cylinder.
5. Beaker. The beaker has a capacity of 600 ml.
6. Tray. The tray is either a metal or plastic square, is smooth and level, and has a side length of at least 2 times the diameter of the graduated cylinder.
7. Ring stand.
8. Ring clamp.
9. Metal gate. The metal gate is a smooth circular disk having a diameter of at least greater than the diameter of the bottom opening of the funnel.

Conditions: The procedure is carried out indoors at conditions of 20° C. temperature, $1\times10^5 Nm^{-2}$ pressure and a relative humidity of 25%.

Procedure:

1. Weigh the graduated cylinder to the nearest 0.5 g using the balance. Place the graduated cylinder in the tray so that it is horizontal with the opening facing upwards.
2. Support the funnel on a ring clamp, which is then fixed to a ring stand such that the top of the funnel is horizontal and rigidly in position. Adjust the height of the funnel so that its bottom position is 38 mm above the top centre of the graduated cylinder.
3. Support the metal gate so as to form an air-tight closure of the bottom opening of the funnel.
4. Completely fill the beaker with a 24 hour old powder sample and pour the powder sample into the top opening of the funnel from a height of 2 cm above the top of the funnel.
5. Allow the powder sample to remain in the funnel for 10 seconds, and then quickly and completely remove the metal gate so as to open the bottom opening of the funnel and allow the powder sample to fall into the graduated cylinder such that it completely fills the graduated cylinder and forms an overtop. Other than the flow of the powder sample, no other external force, such as tapping, moving, touching, shaking, etc, is applied to the graduated cylinder. This is to minimize any further compaction of the powder sample.
6. Allow the powder sample to remain in the graduated cylinder for 10 seconds, and then carefully remove the overtop using the flat edge of the spatula so that the graduated cylinder is exactly full. Other than carefully removing the overtop, no other external force, such as tapping, moving, touching, shaking, etc, is applied to the graduated cylinder. This is to minimize any further compaction of the powder sample.
7. Immediately and carefully transfer the graduated cylinder to the balance without spilling any powder sample. Determine the weight of the graduated cylinder and its powder sample content to the nearest 0.5 g.
8. Calculate the weight of the powder sample in the graduated cylinder by subtracting the weight of the graduated cylinder measured in step 1 from the weight of the graduated cylinder and its powder sample content measured in step 7.
9. Immediately repeat steps 1 to 8 with two other replica powder samples.
10. Determine the mean weight of all three powder samples.
11. Determine the bulk density of the powder sample in g/l by multiplying the mean weight calculated in step 10 by 2.0.

EXAMPLES

Example 1

A Spray-Dried Laundry Detergent Powder and Process of Making it

Aqueous slurry composition.

| Component | % w/w Aqueous slurry |
|---|---|
| Linear alkyl benzene sulphonate | 10.6 |
| Acrylate/maleate copolymer | 4.6 |
| Ethylenediamine disuccinic acid and/or Hydroxyethane di(methylene phosphonic acid) | 1.4 |
| Sodium carbonate | 19.4 |
| Sodium sulphate | 28.6 |
| Water | 34.0 |
| Miscellaneous, such as magnesium sulphate, brightener, and one or more stabilizers | 1.4 |
| Total Parts | 100.00 |

Preparation of a Spray-Dried Laundry Detergent Powder.

An aqueous slurry having the composition as described above is prepared having a moisture content of 34.0%. Any ingredient added above in liquid form is heated to 70° C., such that the aqueous slurry is never at a temperature below 70° C. At the end of preparation, the aqueous slurry is heated to 80° C. and pumped under pressure ($5\times10^6 Nm^{-2}$), into a counter current spray-drying tower with an air inlet temperature of from 290° C. The aqueous slurry is atomised and the atomised slurry is dried to produce a solid mixture, which is then cooled and sieved to remove oversize material (>1.8 mm) to form a spray-dried powder, which is free-flowing. Fine material (<0.15 mm) is elutriated with the exhaust the exhaust air in the spray-drying tower and collected in a post tower containment system. The spray-dried powder has a moisture content of 2.0 wt %, a bulk density of 310 g/l and a particle size distribution such that greater than 90 wt % of the spray-dried powder has a particle size of from 150 to 710 micrometers. The composition of the spray-dried powder is given below.

Spray-dried laundry detergent powder composition.

| Component | % w/w Spray Dried Powder |
|---|---|
| Linear alkyl benzene sulphonate | 15.8 |
| Acrylate/maleate copolymer | 6.8 |
| Ethylenediamine disuccinic acid and/or Hydroxyethane di(methylene phosphonic acid) | 2.1 |
| Sodium carbonate | 28.7 |
| Sodium sulphate | 42.4 |
| Water | 2.0 |
| Miscellaneous, such as magnesium sulphate, brightener, and one or more stabilizers | 2.2 |
| Total Parts | 100.00 |

Example 2

A Spray Dried Laundry Detergent Powder and Process of Making it

Aqueous slurry composition.

| Component | % w/w Aqueous slurry |
|---|---|
| Linear alkyl benzene sulphonate | 21.3 |
| Acrylate/maleate copolymer | 9.4 |
| Ethylenediamine disuccinic acid and/or Hydroxyethane di(methylene phosphonic acid) | 1.7 |
| Sodium carbonate | 18.8 |
| Carboxy-methyl-cellulose polymer | 4.3 |
| Water | 42.0 |
| Miscellaneous such as magnesium sulphate, brightener, and one or more stabilizers | 2.5 |
| Total Parts | 100.00 |

Preparation of a Spray-Dried Laundry Detergent Powder.

An aqueous slurry having the composition as described above is prepared having a moisture content of 42.0%. Any ingredient added above in liquid form is heated to 70° C., such that the aqueous slurry is never at a temperature below 70° C. At the end of preparation, the aqueous slurry is heated to 85° C. and pumped under pressure (from $6.5\times10^6 Nm^{-2}$), into a counter current spray-drying tower with an air inlet temperature of from 275° C. The aqueous slurry is atomised and the atomised slurry is dried to produce a solid mixture, which is then cooled and sieved to remove oversize material (>1.8 mm) to form a spray-dried powder, which is free-flowing. Fine material (<0.15 mm) is elutriated with the exhaust the exhaust air in the spray-drying tower and collected in a post tower containment system. The spray-dried powder has a moisture content of 3.0 wt %, a bulk density of 250 g/l and a particle size distribution such that greater than 90 wt % of the spray-dried powder has a particle size of from 150 to 710 micrometers. The composition of the spray-dried powder is given below.

Spray-dried laundry detergent powder composition.

| Component | % w/w Spray Dried Powder |
|---|---|
| Linear alkyl benzene sulphonate | 35.7 |
| Acrylate/maleate copolymer | 15.7 |
| Ethylenediamine disuccinic acid and/or Hydroxyethane di(methylene phosphonic acid) | 2.9 |
| Sodium carbonate | 31.4 |
| Carboxy-methyl-cellulose polymer | 7.1 |
| Water | 3.0 |
| Miscellaneous, such as magnesium sulphate, brightener, and one or more stabilizers | 4.2 |
| Total Parts | 100.00 |

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention claimed is:

1. A spray-drying process for the preparation of a spray-dried detergent powder having a bulk density of from about 50 g/l to about 325 g/l comprising:

(a) preparing an aqueous slurry suitable for spray-drying comprising from about 30 wt % to about 60 wt % water and from about 40 wt % to about 70 wt % non-aqueous material comprising an anionic surfactant, a polymeric carboxylate and a carbonate salt; and (b) spraying the slurry into a spray-drying tower at a pressure in the range of from about $5.0\times10^6$ $Nm^{-2}$ to about $7.0\times10^6$ $Nm^{-2}$; wherein said spray-dried detergent powder contains from 35.7 to 70 wt % of said anionic surfactant and at least 5 wt % of said polymeric carboxylate; and wherein said spray-dried detergent powder is essentially free from zeolite and silicate salt.

2. A process according to claim 1, wherein the aqueous slurry comprises from about 40 wt % to about 50 wt % water and from about 50 wt % to about 60 wt % non-aqueous material.

3. A process according to claim 1 wherein the slurry is sprayed into the spray-drying tower through a nozzle having an aperture having a diameter in the range of from 3 mm to 4 mm.

4. A process according to claim 1 wherein the ratio of (i) the rate in $gs^{-1}$ units at which the aqueous slurry is sprayed into the spray-drying tower to (ii) the maximum cross-sectional area in $m^2$ units of the spray-drying tower is in the range of from about 40 to about 250 $gm^{-2}s^{-1}$.

5. A process according to claim 1 wherein:

(a) the weight ratio of anionic surfactant to polymeric carboxylate is in the range of from about 2:1 to about 3:1;

(b) the weight ratio of carbonate salt to anionic surfactant is in the range of from about 0.5:1 to about 2:1; and (c) the weight ratio of carbonate salt to polymeric carboxylate is in the range of from about 1.5:1 to about 4:1.

6. A process according to claim 1 wherein the non-aqueous material comprises alkyl benzene sulphonate anionic detersive surfactant.

7. The method of claim 1 wherein the air flow rate in the spray-drying tower is in the range of from about 15 $m^3s^{-2}$ to about 30 $m^3s^{-1}$, wherein the maximum cross-sectional area of the spray-drying tower is in the range of from about 20 $m^2$ to about 40 $m^2$, and wherein the ratio of the air flow rate in $m^3s^{-1}$ units in the spray-drying tower to the maximum cross sectional area of the spray-drying tower in $m^2$ units is in the range of from about 0.2 $ms^{-1}$ to about 1.0 $ms^{-1}$.

8. The spray-drying process of claim 1 wherein said spray-dried detergent powder further comprises from about 0 wt % to about 10 wt % phosphate builder.

9. The spray-drying process of claim 1 wherein the temperature of the slurry as it enters the spray-drying tower is in the range of from about 65° C. to about 140° C., and wherein the outlet air temperature of the spray-drying tower is in the range of from about 70° C. to about 120° C.

10. A spray-drying process for the preparation of a spray-dried detergent powder having a bulk density of from about 50 g/l to about 325 g/l comprising:

(a) preparing an aqueous slurry suitable for spray-drying comprising from about 30 wt % to about 60 wt % water and from about 40 wt % to about 70 wt % of a non-aqueous material comprising an anionic surfactant, a polymeric carboxylate, and a carbonate salt, where the weight ratio of anionic surfactant to polymeric carboxylate is in the range of from about 2:1 to about 3:1; the weight ratio of carbonate salt to anionic surfactant is in the range of from about 0.5:1 to about 2:1; and the weight ratio of carbonate salt to polymeric carboxylate is in the range of from about 1.5:1 to about 4:1; and (b) spraying the slurry into a spray-drying tower at a pressure of from about $5.0\times10^6$ $Nm^{-2}$ to about $7.0\times10^6$ $Nm^{-2}$ wherein said spray-dried detergent powder contains from 35.7 to 70 wt % of said anionic surfactant and at least 5 wt % of said polymeric carboxylate; and wherein said spray-dried detergent powder is essentially free from zeolite and silicate salt.

* * * * *